US011994020B2

(12) United States Patent
Chen et al.

(10) Patent No.: US 11,994,020 B2
(45) Date of Patent: May 28, 2024

(54) MAPPING INTER-WELL POROSITY USING TRACERS WITH DIFFERENT TRANSPORT PROPERTIES

(71) Applicant: ARAMCO SERVICES COMPANY, Houston, TX (US)

(72) Inventors: Hsieh Chen, Cambridge, MA (US); Martin E. Poitzsch, Northumberland, NH (US); Hooisweng Ow, Woburn, MA (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/933,910

(22) Filed: Sep. 21, 2022

(65) Prior Publication Data

US 2024/0093598 A1 Mar. 21, 2024

(51) Int. Cl.
*E21B 47/11* (2012.01)
*E21B 49/00* (2006.01)

(52) U.S. Cl.
CPC ..... *E21B 47/11* (2020.05); *E21B 49/008* (2013.01); *E21B 2200/20* (2020.05); *E21B 2200/22* (2020.05)

(58) Field of Classification Search
CPC ..... E21B 47/11; E21B 43/16; E21B 49/08; E21B 49/0875; E21B 43/25; E21B 49/10
See application file for complete search history.

(56) References Cited

U.S. PATENT DOCUMENTS

| | | | | |
|---|---|---|---|---|
| 3,590,923 | A * | 7/1971 | Cooke, Jr. | C09K 8/58 166/252.6 |
| 8,603,827 | B2 | 12/2013 | Zahlsen et al. | |
| 10,858,931 | B2 | 12/2020 | Chen et al. | |
| 11,230,919 | B2 | 1/2022 | Ow et al. | |
| 11,261,300 | B2 | 3/2022 | Kim et al. | |
| 2017/0067323 | A1 | 3/2017 | Katterbauer et al. | |
| 2019/0218907 | A1* | 7/2019 | Ow | C07D 401/04 |
| 2021/0025858 | A1 | 1/2021 | Ow et al. | |

FOREIGN PATENT DOCUMENTS

| | | | |
|---|---|---|---|
| KR | 101996182 | B1 | 7/2019 |
| WO | 2010/132395 | A1 | 11/2010 |
| WO | WO-2017136641 | A1 * | 8/2017 |

OTHER PUBLICATIONS

Dawson et al., "Inaccessible Pore Volume in Polymer Flooding," Society of Petroleum Engineers, SPE 352-PA, 1972, 5 pages.

(Continued)

*Primary Examiner* — Zakiya W Bates
(74) *Attorney, Agent, or Firm* — Osha Bergman Watanabe & Burton LLP

(57) ABSTRACT

A method for mapping inter-well porosity includes injecting a Type 1 tracer into a hydrocarbon-bearing reservoir via an injector well, wherein the Type 1 tracer is a passive tracer, injecting a Type 2 tracer into the hydrocarbon-bearing reservoir via the injector well, wherein the Type 2 tracer is a porosity-sensitive tracer, detecting a breakthrough of the Type 1 tracer and a breakthrough of the Type 2 tracer in produced fluid at a producer well, and comparing the breakthrough of the Type 1 tracer with the breakthrough of the Type 2 tracer to provide a map of inter-well porosity.

18 Claims, 12 Drawing Sheets

(56) References Cited

OTHER PUBLICATIONS

He et al., "Brine-Soluble Zwitterionic Copolymers with Tunable Adsorption on Rocks," Applied Materials & Interfaces, 2020, 7 pages.
Ow et al., "First Deployment of a Novel Advanced Tracers System for Improved Waterflood Recovery Optimization," Society of Petroleum Engineers, SPE-192598-MS, 2018, 10 pages.
Feitosa-Felizzola, Juliana et al., "Adsorption and transformation of selected human-used macrolide antibacterial agents with iron(III) and manganese(IV) oxides"; Environmental Pollution; vol. 157, Issue 4; pp. 1317-1322; Apr. 2009 (6 pages).
Keleman, Peter et al., "An Overview of the Status and Challenges of CO2 Storage in Minerals and Geological Formations"; Frontiers in Climate; vol. 1, Article 9; pp. 1-20; Nov. 15, 2019 (20 pages).
Hills, Colin D. et al., "Mineralization Technology for Carbon Capture, Utilization, and Storage"; Frontiers in Energy Research; vol. 8, Article 142; pp. 1-14; Jul. 14, 2020 (14 pages).
Schaefer, Martha W., "Measurements of iron(III)-rich fayalites"; Nature; vol. 303, Issue 5915; pp. 325-327; May 26, 1983 (3 pages).
Pogge Von Strandmann, Philip A. E. et al., "The Dissolution of Olivine Added to Soil at 4° C.: Implications for Enhanced Weathering in Cold Regions"; Frontiers in Climate; vol. 4, Article 827698; pp. 1-11; Feb. 10, 2022 (11 pages).
Neubeck, Anna et al., "Formation of H2 and CH4 by weathering of olivine at temperatures between 30 and 70° C." Geochemical Transactions; vol. 12, Issue 1, Article: 6; pp. 1-10; Dec. 2011 (10 pages).
Wogelius, Roy A. et al., "Olivine dissolution at 25° C.: Effects of pH, CO2, and organic acids"; Geochimica et Cosmochimica Acta; vol. 55, Issue 4; pp. 943-954; Apr. 1991 (12 pages).
Muneishi, Keisuke et al., "Interactions between organic compounds and olivine under aqueous conditions: A potential role for organic distribution in carbonaceous chondrites"; Meteoritics & Planetary Science; vol. 56, Issue 2; pp. 195-205; Feb. 2021 (11 pages).
Aradóttir, Edda S.P. et al., "CarbFix: a CCS pilot project imitating and accelerating natural CO2 sequestration"; Greenhouse Gases: Science and Technology; vol. 1, Issue 2; pp. 105-118; Jun. 2011 (14 pages).
Aradóttir, E.S.P. et al., "Multidimensional reactive transport modeling of CO2 mineral sequestration in basalts at the Hellisheidi geothermal field, Iceland"; International Journal of Greenhouse Gas Control; vol. 9; pp. 24-40; Jul. 2012 (17 pages).
Min, Baehyun et al., "Selection of Geologic Models Based on Pareto-Optimality Using Surface Deformation and CO2 Injection Data for the in Salah Gas Sequestration Project"; Proceedings of the SPE Annual Technical Conference and Exhibition; Paper No. SPE-181569-MS; pp. 1-25; Sep. 26, 2016 (25 pages).
Hovorka, Susan D., "Optimization of Geological Environments for Carbon Dioxide Disposal in Saline Aquifers in the United States"; Bureau of Economic Geology, Jackson School of Geosciences, The University of Texas at Austin; Contract No. DE-AC26-98FT40417; May 2009 (480 pages).

* cited by examiner

MAPPING INTER-WELL POROSITY USING TRACERS WITH DIFFERENT TRANSPORT PROPERTIES

BACKGROUND

Understanding porosity distributions of a subterranean formation is important in all stages of exploration and production of hydrocarbon reservoirs. For example, porosity distributions may be used to estimate the original oil/gas in place (OOIP/OGIP) and recoverable preserves, as well as to select the appropriate primary and/or secondary hydrocarbon recovery mechanisms and methods. In near wellbore regions, porosity distributions may be analyzed by acquiring core samples for core analysis or by a variety of different logging methods. In contrast, in regions further away from the wellbore, such as inter-well regions, the porosity distributions are difficult to measure directly, and thus are often inferred based on seismic data.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for mapping inter-well porosity including injecting a Type 1 tracer into a hydrocarbon-bearing reservoir via an injector well, wherein the Type 1 tracer is a passive tracer, injecting a Type 2 tracer into the hydrocarbon-bearing reservoir via the injector well, wherein the Type 2 tracer is a porosity-sensitive tracer, detecting a breakthrough of the Type 1 tracer and a breakthrough of the Type 2 tracer in produced fluid at a producer well, and comparing the breakthrough of the Type 1 tracer with the breakthrough of the Type 2 tracer to provide a map of inter-well porosity.

In another aspect, embodiments disclosed herein relate to a method of reconstructing inter-well porosity of a hydrocarbon-bearing reservoir using Type 1 tracer breakthrough data and Type 2 tracer breakthrough data. The method includes obtaining an initial reservoir model, performing reservoir simulation using the initial reservoir model to predict hydrocarbon production rate, water production rate, Type 1 tracer breakthrough data, and Type 2 breakthrough data from a producer well, obtaining a real field hydrocarbon production rate, real water production rate, real Type 1 tracer breakthrough data, and real Type 2 tracer breakthrough data from the producer well, and performing data assimilation by comparing real field production, Type 1 tracer breakthrough data, and Type 2 tracer breakthrough data with the predicted production, Type 1 tracer breakthrough data, and Type 2 tracer breakthrough data obtained from the reservoir simulation using the initial reservoir model.

Other aspects and advantages of the claimed subject matter will be apparent from the following description and the appended claims.

DETAILED DESCRIPTION

The present disclosure generally relates to a method of mapping inter-well porosity. In one or more embodiments, two different types of tracers are used to map the porosity of a subterranean formation between two wells. The method may include injecting a first type of tracer and a second type of tracer into an injector well and then detecting each type of tracer at a producer well. The first and second types of tracers may differ in the way each is transported through a porous media, and as such, one tracer may be detected at the producer well before the other. Accordingly, the detection times of the two different types of tracers may be compared to provide insight about the porosity of the inter-well region.

Figure 1:
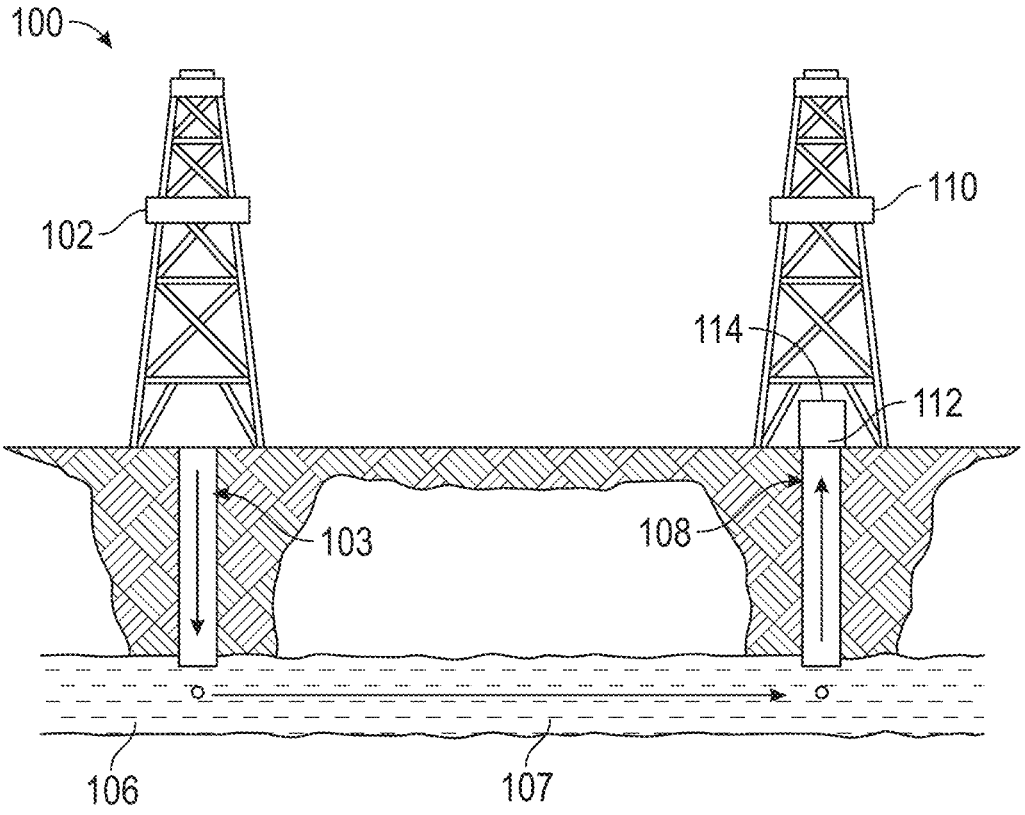
FIG. 1 is a schematic diagram of a system for a hydrocarbon-bearing formation in accordance with one or more embodiments of the present disclosure.

A schematic diagram that illustrates a hydrocarbon-bearing formation 100 in accordance with one or more embodiments is shown in FIG. 1. The formation 100 includes a first wellbore drilling system 102 located at an injection site. In the disclosed method, the two different types of tracers may be injected through an injector well 103 at the injection site using first wellbore drilling system 102, such that the tracers mix with subsurface fluid 106. Subsurface fluid 106 may flow through an inter-well region 107 of a hydrocarbon-bearing formation to a producer well 108 at a producing site. The producing site may include a second wellbore drilling system 110. Subsurface fluid 106 may be extracted at the producer well 108 using the second wellbore drilling system 110. The second wellbore drilling system 110 may be equipped with a tracer detection unit 112 on the surface to detect the recovered tracers. In some embodiments, tracer detection unit 112 may include a comparative unit 114. Comparative unit 114 may be configured to compare the breakthrough curves of each type of tracer and provide information about the porosity of inter-well region 107.

Hydrocarbon-bearing formations in accordance with the present disclosure may include oleaginous fluid, such as crude oil, dry gas, wet gas, gas condensates, light hydrocarbon liquids, tars, and asphalts, as well as other hydrocarbon materials. Hydrocarbon-bearing formations may also include aqueous fluid such as water and brines. The two different types of tracers disclosed herein may be appropriate for use in different types of subterranean formations, such as carbonate, shale, sandstone, and tar sands.

Figure 2:
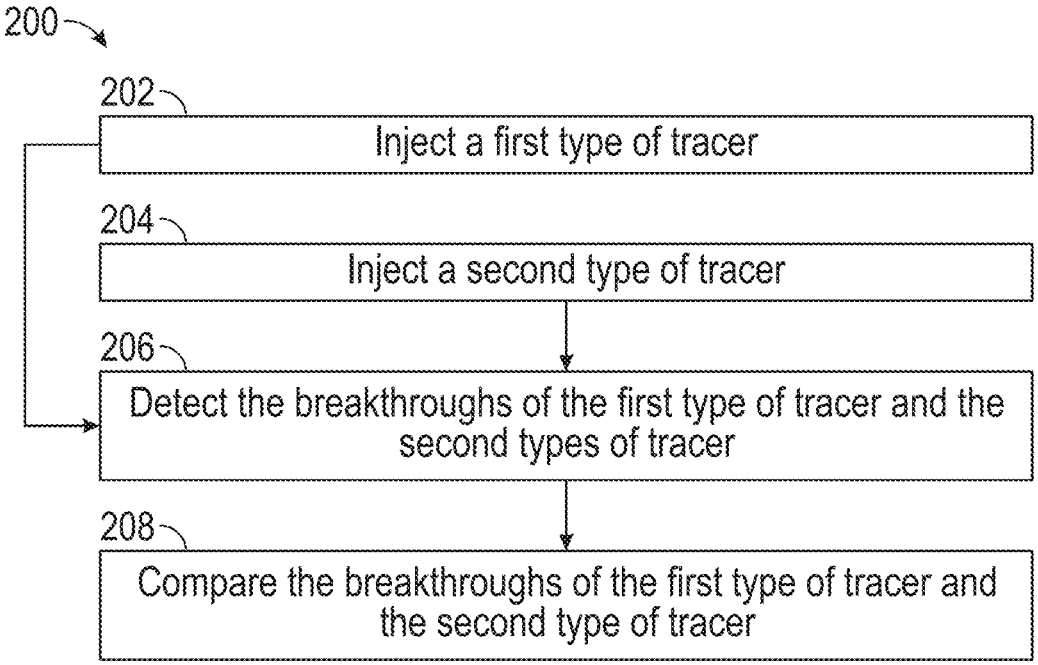
FIG. 2 is a block-flow diagram of a method in accordance with one or more embodiments of the present disclosure.

A method for mapping the inter-well porosity between an injector well 103 and a producer well 108 of a hydrocarbon-bearing formation in accordance with one or more embodiments is shown in and discussed with reference to FIG. 2. In method 200, a first type of tracer, referred to as a Type 1 tracer, may be injected into an injector well (e.g., injector well 103 shown in FIG. 1), step 202. In some embodiments, the Type 1 tracer is injected into the formation neat. Tracers that are injected into the formation neat may be injected without any solution base fluid. Accordingly, in such embodiments, the tracer itself may be in the form of a liquid. In other embodiments, the Type 1 tracer is injected into the formation in an injection fluid. The injection fluid may be any aqueous-based injection fluid known in the art. The Type 1 tracer may be included in an injection fluid in an amount, for example, ranging from 1 to 1,000 kg mixed with injection fluid, such that the injection fluid has a concentration ranging from 1 to 100,000 ppm of the Type 1 tracer. For example, Type 1 tracers with masses ranging from 1 to 10 kg may be mixed with 400 L of water (or other carrier fluid) to form an injection fluid having a Type 1 tracer concentration ranging from 2,500 to 25,000 ppm. In one or more embodiments, the concentration of Type 1 tracer in the injection fluid may range from a lower limit of one of 1, 10, 50, 100, 200, 500, and 1,000 ppm to an upper limit of one of 2,000, 5,000, 10,000, 25,000 50,000, and 100,000 ppm, where any lower limit may be paired with any mathematically compatible upper limit.

The Type 1 tracer may be a passive tracer. A passive tracer is a tracer that does not interact with the reservoir matrix. As such, the transport of passive tracers through a reservoir is not affected by properties of the formation such as, for example, porosity and permeability. Any passive tracer known in the art may be used in the disclosed method, provided that it has a sufficient thermal stability. For example, a passive tracer that may be used as a Type 1 tracer may not degrade at temperatures of at least 100° C. for 3 to 6 months. Exemplary Type 1 tracers include, but are not limited to, ions such as sodium thiocyanate (NaSCN) and sodium bromide (NaBr), small molecules such as fluorobenzoic acids (FBA), e.g., 2-fluorobenzoic acid, 3-fluorobenzoic acid, 4-fluorobenzoic acid, 2,3-difluorobenzoic acid, 2,4-difluorobenzoic acid, 2,5-difluorobenzoic acid, 3,4-difluorobenzoic acid, dipicolinic acid (DPA), 4,7-bis (sulfonatophenyl)-1,10-phenanthroline-2,9-dicarboxylic acid (BSPPDA), and combinations thereof.

Method 200 also includes injecting a second type of tracer, referred to as a Type 2 tracer, into the injector well, step 204. In one or more embodiments, the Type 2 tracer and the Type 1 tracer are injected concurrently. As described above, the Type 1 tracer may be included in an injection fluid. In such embodiments, the Type 2 tracer may be included in the injection fluid with the Type 1 tracer. The Type 2 tracer may be included in the injection fluid in an amount ranging from 1 to 1,000 kg such that the injection fluid has a concentration of 1 to 100,000 ppm of the Type 2 tracer. In one or more embodiments, the concentration of Type 2 tracer in the injection fluid ranges from a lower limit of one of 1, 10, 50, 100, 200, 500, and 1,000 ppm to an upper limit of one of 2,000, 5,000, 10,000, 25,000 50,000, and 100,000 ppm, where any lower limit may be paired with any mathematically compatible upper limit. For example, an injection fluid may include a Type 2 tracer concentration ranging from 5,000 to 30,000 ppm (e.g., 0.5 to 3 wt %). In other embodiments, the second type of tracer may be injected into the injector well neat.

In one or more embodiments, the Type 1 tracer and the Type 2 tracer are injected at the same time, whether or not they are each included in the injection fluid. For example, Type 1 and Type 2 tracers may be injected concurrently in a single carrier fluid, may be injected concurrently neat (without a carrier fluid), or may be injected concurrently in separate carrier fluids. In other embodiments, the Type 1 and Type 2 tracers are injected at different times. Whether Type 1 and Type 2 tracers are injected concurrently or at different times, the breakthrough times for each type of tracer may be tracked to preform reservoir analysis according to embodiments of the present disclosure.

In one or more embodiments, the Type 2 tracer is a porosity-sensitive tracer. As such, the Type 2 tracer may interact with the reservoir matrix such that its transport through the formation is affected by the properties of the formation, such as, for example, porosity and permeability. In one or more embodiments, the Type 2 tracer has a form that causes interaction with a porous media of the reservoir matrix. For example, the Type 2 tracer may be too large to be transported through smaller pores, which may be referred to herein as "inaccessible pore volume" (IPV). IPV is measured as a percentage of pore volume (PV), and may range from 0% to about 50% of the total PV, depending on the particular tracer and rock type combination. Generally, the pore sizes that are smaller than the size of a given molecule, e.g., the size of a Type 2 tracer molecule, can be considered as IPV. Thus, in porous media having IPV, large molecules may not occupy or be connected to the IPV. As such, upon transport through such porous media, large molecules may bypass the IPV, flowing more efficiently and quickly through the formation.

Accordingly, in one or more embodiments, the Type 2 tracer may have a size large enough to bypass the IPV in the reservoir matrix of a hydrocarbon-bearing formation or inter-well region (e.g., 107 in FIG. 1). For example, in one or more embodiments the Type 2 tracer has a size ranging from 10 nm to 10 μm. Type 2 tracers may have a size ranging from a lower limit of one of 10, 50, 100, 250, 500, and 1,000 nm to an upper limit of one of 2, 4, 6, 8, and 10 μm, where any lower limit may be paired with any mathematically compatible upper limit.

In one or more embodiments, the Type 2 tracer may have a weight average molecular weight (Mw) ranging from 30,000 Da to 20,000,000 Da. For example, Type 2 tracers may have an Mw ranging from a lower limit of one of 30,000, 50,000, 1,000,000, and 2,000,000 Da to an upper limit of one of 5,000,000, 10,000,000, 15,000,000, and 20,000,000 Da, where any lower limit may be paired with any mathematically compatible upper limit.

Other features of the rock type and specific tracer combination can affect the IPV. For example, the rigidity of the tracer and the rock pore shapes, among others, may either hinder or facilitate a tracer's passthrough through the rock, and thus effect the IPV. As such, in some embodiments, other properties of the Type 2 tracer, such as its shape, rigidity, and/or chemistry may affect its interaction with the reservoir matrix, and thus the IPV.

The Type 2 tracer of one or more embodiments may be selected such that it has an IPV of 10 to 50% of total PV, in the target formation. For example, Type 2 tracers may have an IPV ranging from a lower limit of one of 10, 15, 20 and 25% to an upper limit of one of 30, 35, 40, 45 and 50%, where any lower limit may be paired with any mathematically compatible upper limit. Accordingly, a Type 2 tracer with an IPV ranging from 10 to 50% may travel sufficiently faster than a Type 1 tracer in accordance with the present disclosure.

In one or more embodiments, the Type 2 tracer is a polymer. Suitable polymers may include brine-soluble monomers such as, for example, saccharides, sulfonated monomers, hydroxylated monomers, zwitterionic monomers, fluorinated monomers, and combinations thereof. As such, the Type 2 tracer may be a brine-soluble polymer. Exemplary brine-soluble polymers include zwitterionic/fluorinated copolymers such as poly(1-vinyl imidazole-co- 4-trifluoromethylstyrene), poly(3-(1-vinyl-1H-imidazol-3-ium-3-yl)propane-1-sulfonate-co-4-trifluoromethylstyrene), and poly(3-(1-vinyl-1H-imidazol-3-ium-3-yl)propane-1-sulfonate). Additionally, the Type 2 tracer may have a sufficient thermal stability to survive transport between an injector well and a producer well, e.g., where the Type 2 tracer may not degrade at temperatures of at least 100° C. for 3 to 6 months.

In one or more embodiments, polymers used as Type 2 tracers may have a polydispersity ranging from 1.0 to 1.5. In order to achieve a desired polydispersity, Type 2 tracer polymers may be synthesized via controlled/living radical polymerization techniques, which are known in the art to provide good control over the molecular weight and polydispersity of the polymer product. For example, in one or more embodiments, polymers used as Type 2 tracers may be synthesized by reversible addition-fragmentation chain-transfer (RAFT), atom transfer radical polymerization (ATRP), and activator regenerated by electron transfer atom transfer radical polymerization (ARGET ATRP), among others. Using such polymerization techniques, various properties of the resultant polymer may be tuned, for example, for brine solubility, retention to rock matrices, and molecular weight distribution.

In some embodiments, the Type 2 tracer may have a low partitioning coefficient. The extent to which tracers are soluble in oil as compared to water may be described using a partitioning coefficient. The partitioning coefficient is the ratio between the concentration of the chemical in the water phase and the oil phase ($k_p=C_{oil}/C_{water}$). A Type 2 tracer with a high partitioning coefficient may be slowed down by partitioning into the oil phase in the reservoir, thus effectively cancelling out the acceleration effect from bypassing IPV. Thus, suitable Type 2 tracers may have an oil/water partitioning coefficient (K) of less than 0.1.

In method 200, once both types of tracers have been injected into the injector well, each tracer may flow through the formation with the subsurface fluid. The tracers may be downhole for an amount of time ranging from a few weeks to a few years, depending on the distance between the injector well and the producer well. Then, the Type 1 tracer and the Type 2 tracer may be detected at a producer well, step 206. As described above, only the Type 2 tracer may interact with the formation matrix. Such interaction may result in a faster transport of the Type 2 tracer through the formation and earlier detection at the producer well. The tracer breakthrough curves of each type of tracer may be provided based on detection at the producer well. Finally, method 200 includes comparing the breakthrough curves of the Type 1 and Type 2 tracers to reconstruct the porosity of the inter-well region, step 208.

In embodiments in which the formation includes a highly porous matrix, the Type 2 tracer may be detected at the producer well in about half the time of the Type 1 tracer. For example, in a highly porous formation, the type 1 tracer may be detected at a producer well 100 days after being injected into an injector well while the Type 2 tracer may be detected 50 days after being injected. In embodiments in which the formation matrix has a low degree of porosity, the Type 2 tracer may be detected at the producer well in about 90% of the time of the Type 1 tracer. For example, the first type of tracer may be detected at the producer well 100 days after being injected into an injector well while the second type of tracer may be detected 91 days after being injected. As noted above, the Type 1 and Type 2 tracers may remain downhole for an amount of time ranging from a few weeks to a few years. Regardless of the total time downhole, the Type 2 tracer may be detected at the producer well in an amount of time that is 50 to 90% of the time it takes to detect the Type 1 tracer at the producer well.

The Type 1 and Type 2 tracer breakthroughs may be detected according to standard analytical chemistry techniques known in the art. For example, the Type 1 and Type 2 tracer breakthroughs may be detected using solid phase extraction (SPE), gas chromatography-mass spectroscopy (GC-MS), high performance liquid chromatography (HPLC), and combinations thereof.

In one or more embodiments, the Type 1 and Type 2 tracer breakthrough curves are compared using a history matching algorithm. A suitable history matching algorithm may be a modified Ensemble Smoother with Multiple Data Assimilation with Tracers (ES-MDA-Tracer) algorithm. An exemplary implementation of a modified ES-MDA-tracer algorithm may provide an improved reservoir model $m^{l+1}$, written as:

$$m_j^{l+1}=m_j^l+C_{MD}^l(C_{DD}^l+\alpha_{l+1}C_D)^{-1}(d_{uc,j}^l-d_j^l).$$

for j=1, 2, . . . $N_e$, with $N_e$ denoting the number of ensemble members. The term $C_{MD}^l$ is the cross-covariance matrix between the prior vector of model parameters, $m^l$, and the vector of predicted data, $d^l$. The term $C_{DD}^l$ is the $N_d \times N_d$ auto-covariance matrix of predicted data, with $N_d$ denoting the total number of measurements assimilated. The term $d_{uc}^l \sim N(d_{obs}, \alpha_{l+1}C_D)$ is the vector of perturbed observations, with $C_D$ denoting a user defined $N_d \times N_d$ auto-covariance matrix of observed data measurement errors. The terms $\alpha_l$, l=1, 2, . . . $N_a$ are predefined inflation coefficients that satisfy $$\sum_{l=1}^{N_a} \frac{1}{\alpha_1} = 1,$$

with $N_a$ denoting the number of data assimilation iterations.

The $N_d$-dimensional data vector may incorporate measurements such as the oil production rate (opr), water production rate (wpr), and the Type 1 and Type 2 tracer concentrations.

Figure 3:
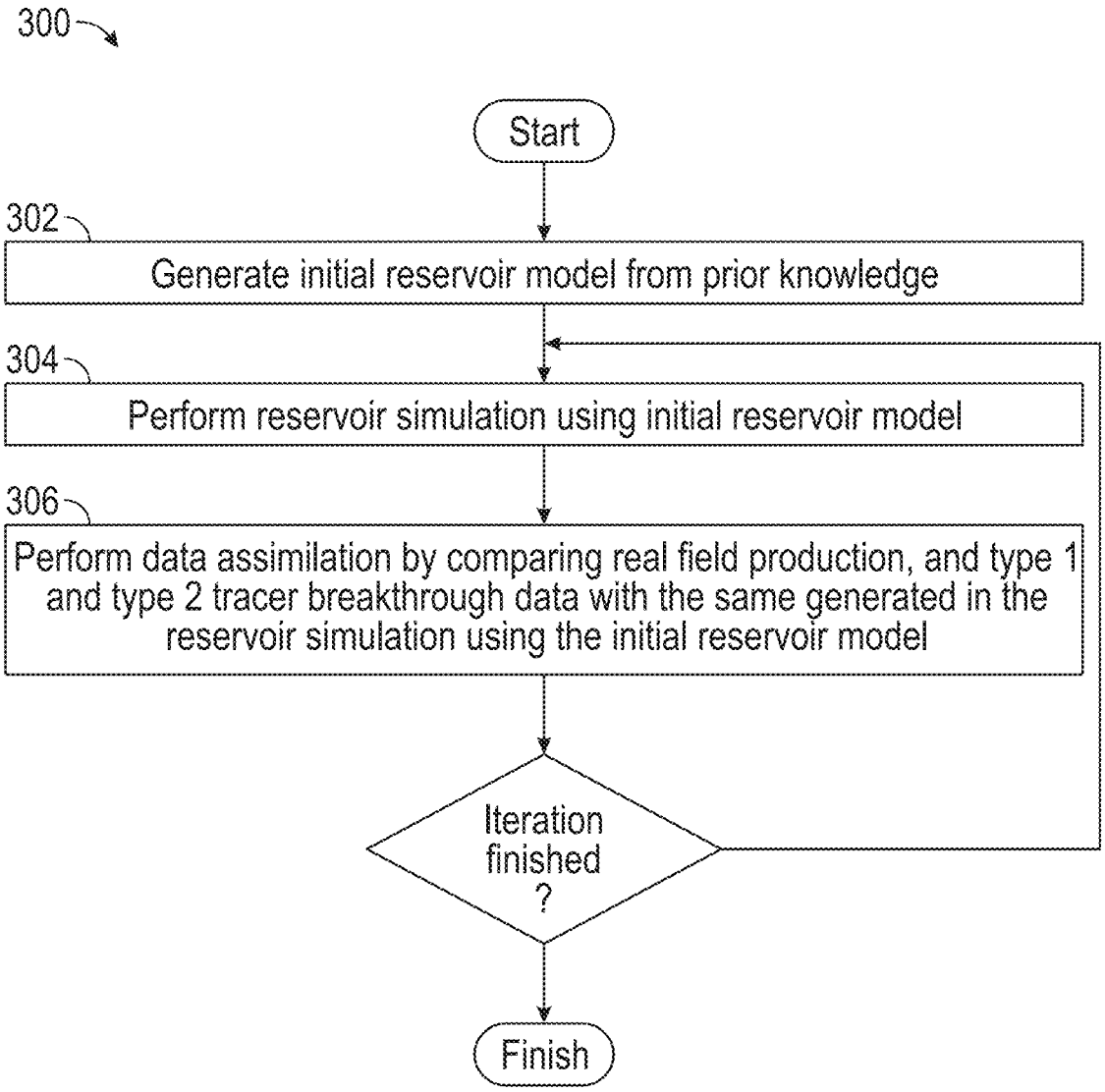
FIG. 3 is a block-flow diagram of a method in accordance with one or more embodiments of the present disclosure.

Such algorithm may be implemented by a reservoir simulator. The reservoir simulator may be able to simulate tracers, as well. A block-flow diagram of a method 300 of implementing an exemplary modified ES-MDA-Tracer algorithm in accordance with one or more embodiments of the present disclosure is shown in FIG. 3. The method 300 may be performed using any suitable system, software, hardware, environment, or combination thereof, known to those having skill in the art.

As shown in FIG. 3, the method 300 may first include generating an initial reservoir model from prior knowledge or data, step 302. The initial reservoir model may be generated using any suitable prior knowledge or data including, but not limited to, generic geological software, ad hoc estimation, and existing models. The initial reservoir model may be saved in vector m of the ES-MDA-Tracer algorithm.

Next, a reservoir simulator may perform reservoir simulations using the initial reservoir model, step 304. The simulations may provide predictions regarding the breakthroughs of the Type 1 and Type 2 tracer, the opr, and the wpr. In some embodiments, multiple simulations are performed. The predicted data may be saved in vector d of the algorithm.

In method 300, data assimilations are then performed by comparing data collected in the field and the reservoir simulator predicted data, step 306. Data collected in the field may be saved in vector $d_{obs}$. Various data may be compared including the breakthrough curve data of Type 1 and Type 2 tracers, the opr, and the wpr.

After performing data assimilations, it may be determined whether or not the iteration is finished. If the iteration is not finished, the method may return to step 304 to perform more reservoir simulations so as to refine the reservoir model. If the iteration is finished, the method 300 is complete and the output is the previously described improved reservoir model.

Examples

Figure 4A:
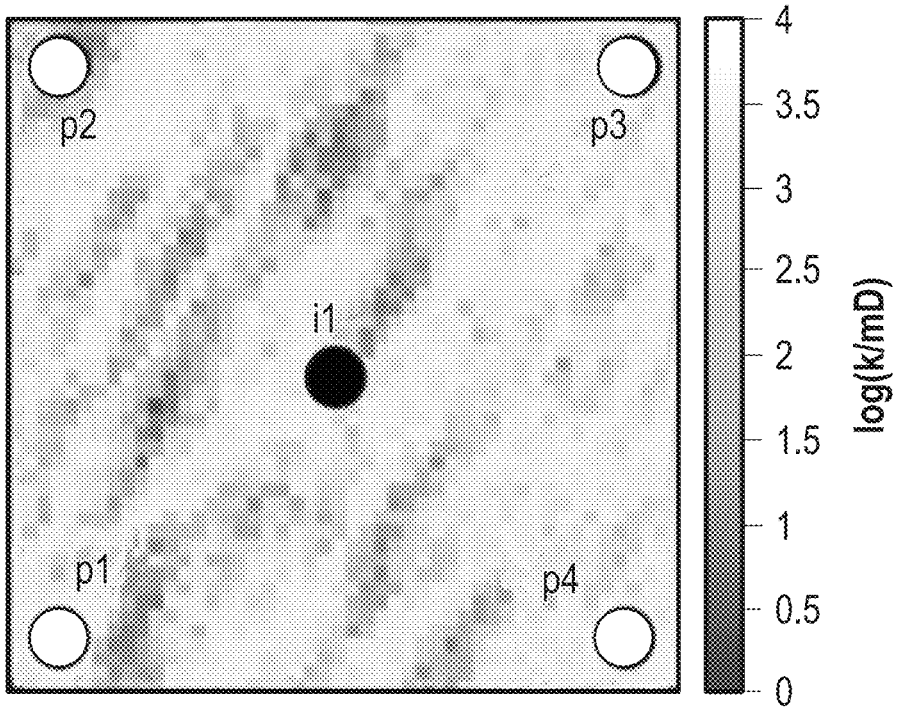
FIG. 4A shows permeability distribution of a reference reservoir model in accordance with one or more embodiments of the present disclosure.
Figure 4B:
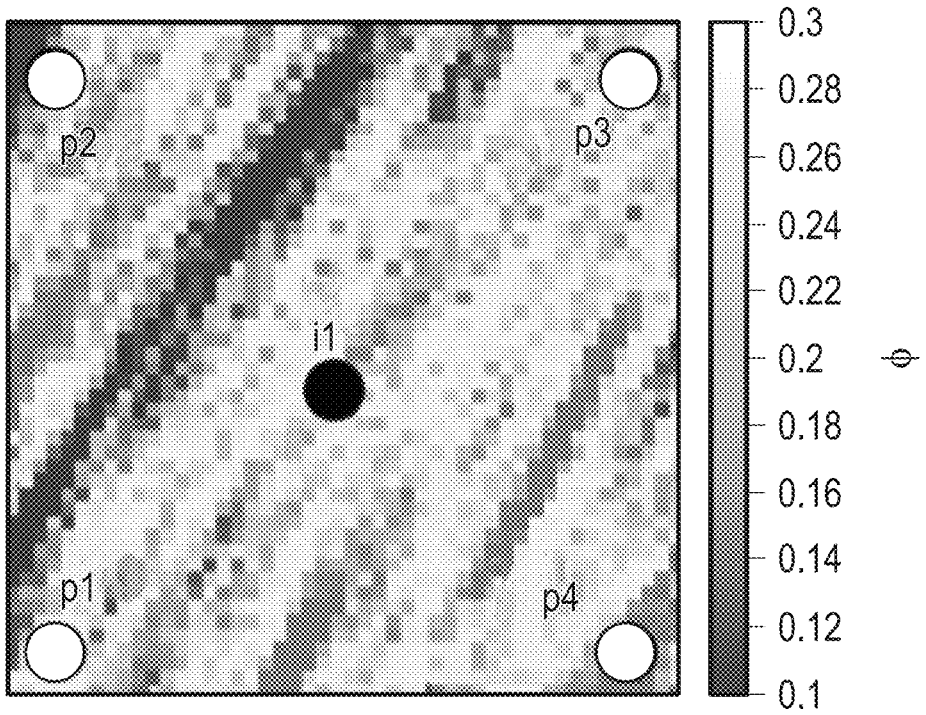
FIG. 4B shows porosity distribution of a reference reservoir model in accordance with one or more embodiments of the present disclosure.

The following numerical experiment was performed to demonstrate the validity of the disclosed method. FIG. 4A shows the permeability distribution (log(k/mD)) and FIG. 4B shows the porosity distribution (φ) of a reference reservoir model with one injector well in the middle (i1) and 4 producer wells at the 4 corners (p1, p2, p3, and p4).

Reservoir simulations were performed using a University of Texas Chemical Compositional Simulator (UTCHEM) to observe the subsurface fluid production and tracer breakthroughs. The simulation grid was 49×49×1, with grid block size of 50 ft×50 ft×50 ft. The total simulation time was 2,000 days. A constant injection rate of 50,000 $ft^3$/day was used at the injector well i1, and constant pressure of 100 psi was used at the producer wells p1, p2, p3, and p4. Pulses of the two types of tracers were injected in the injector well i1 at t=500 day for 1 day. The Type 1 tracer was a normal water tracer. In contrast, the Type 2 tracer was a polymer. For simplicity, both tracers were assumed to have no retention in the formation matrix. In this example the Type 2 tracer had an inaccessible pore volume IPV=50%. Based on the different breakthroughs of the Type 1 and 2 tracers, the permeability distribution (log(k/mD)) and the porosity distribution (φ) of the reference reservoir model was simulated.

Figure 5A:
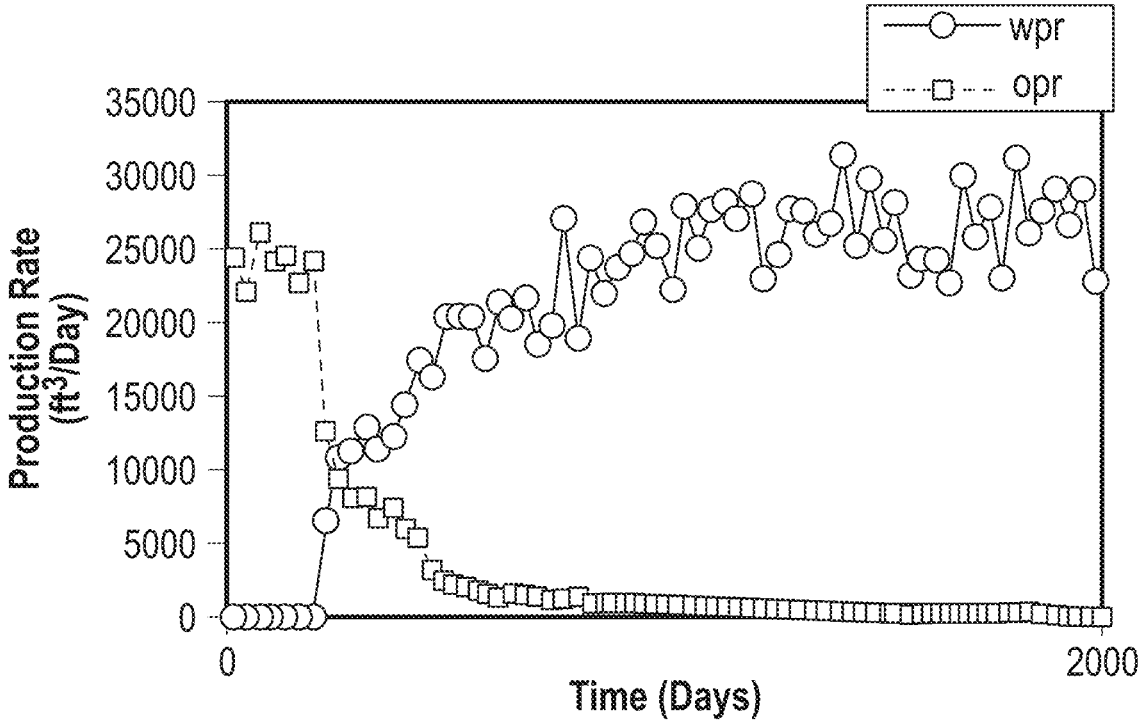
FIGS. 5A-H show graphs of simulated reference data in accordance with embodiments of the present disclosure.
Figure 5B:
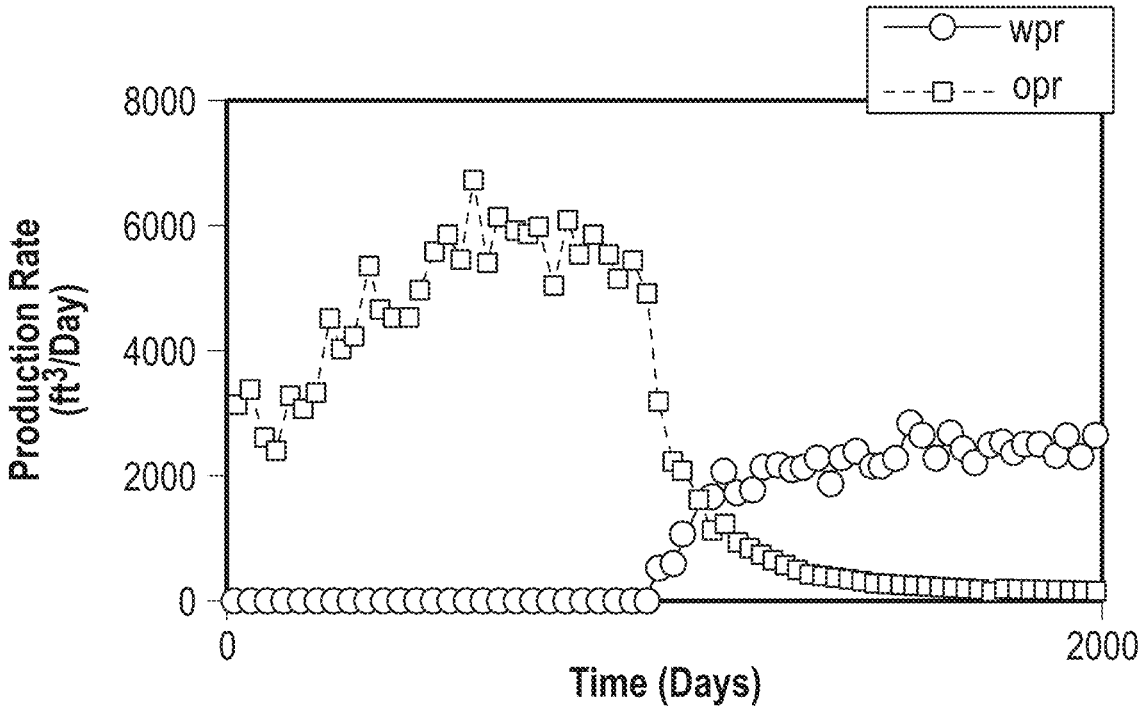
Figure 5C:
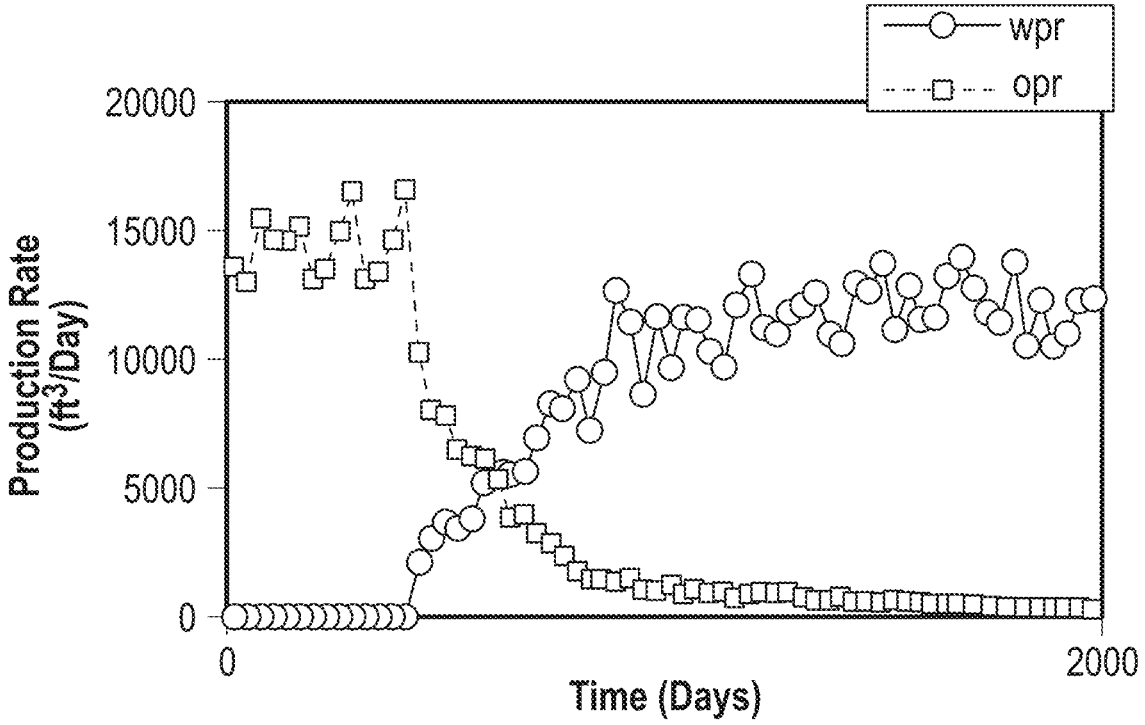
Figure 5D:
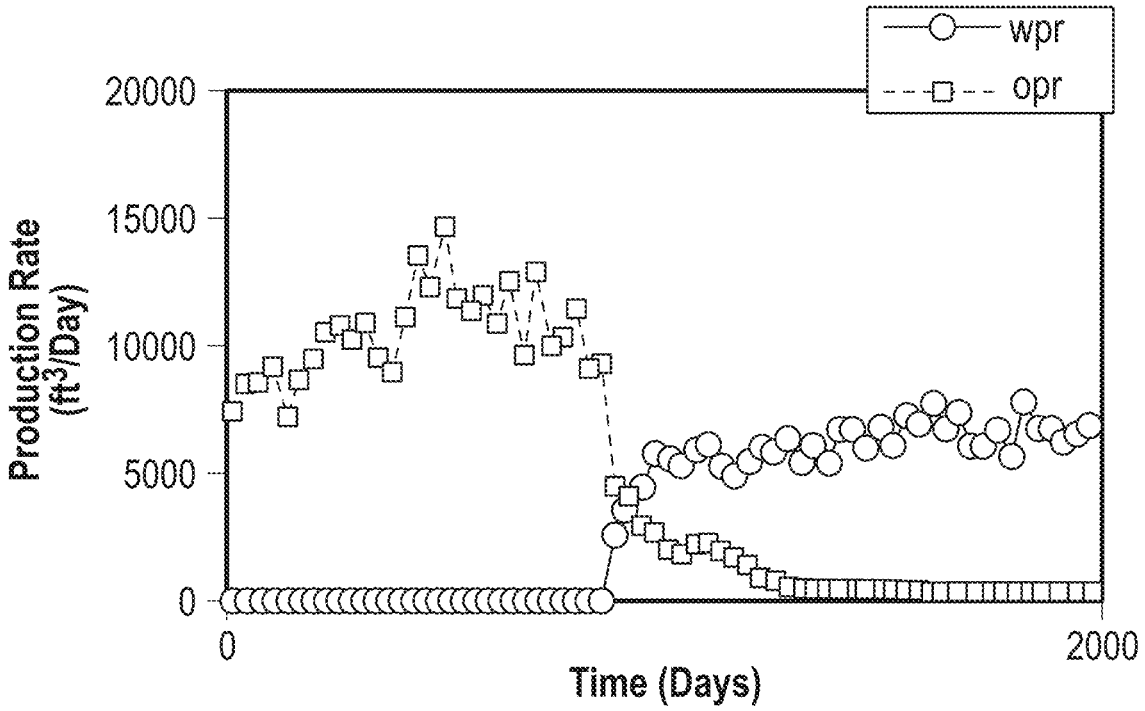
Figure 5E:
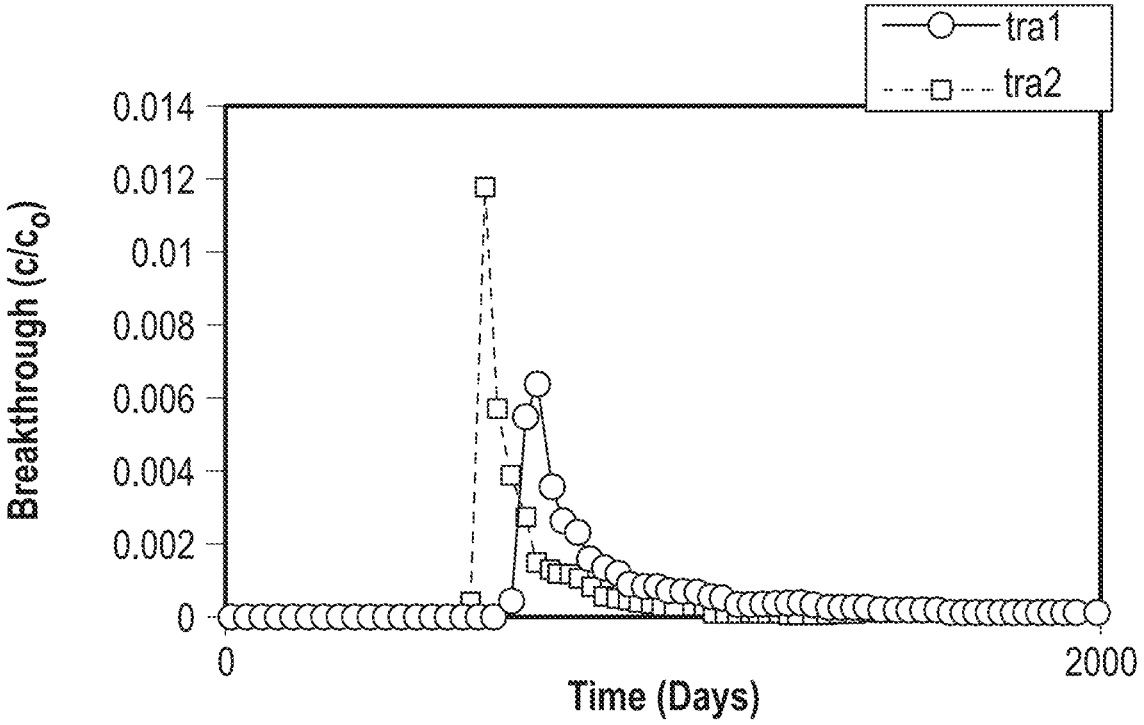
Figure 5F:
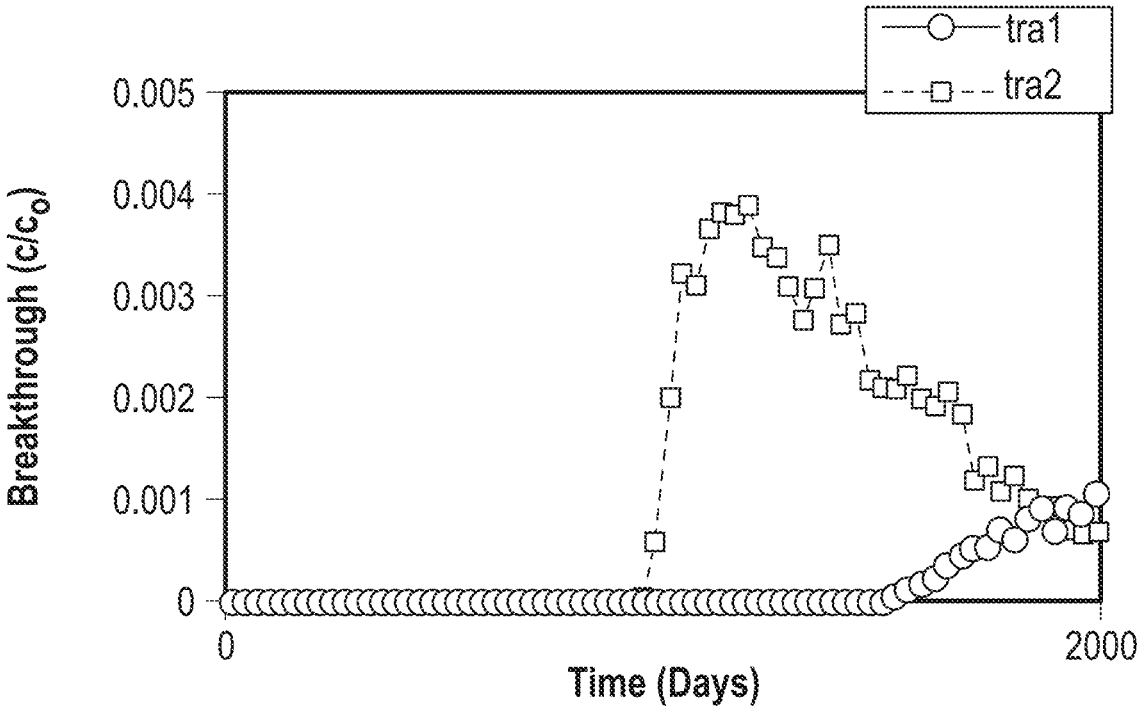
Figure 5G:
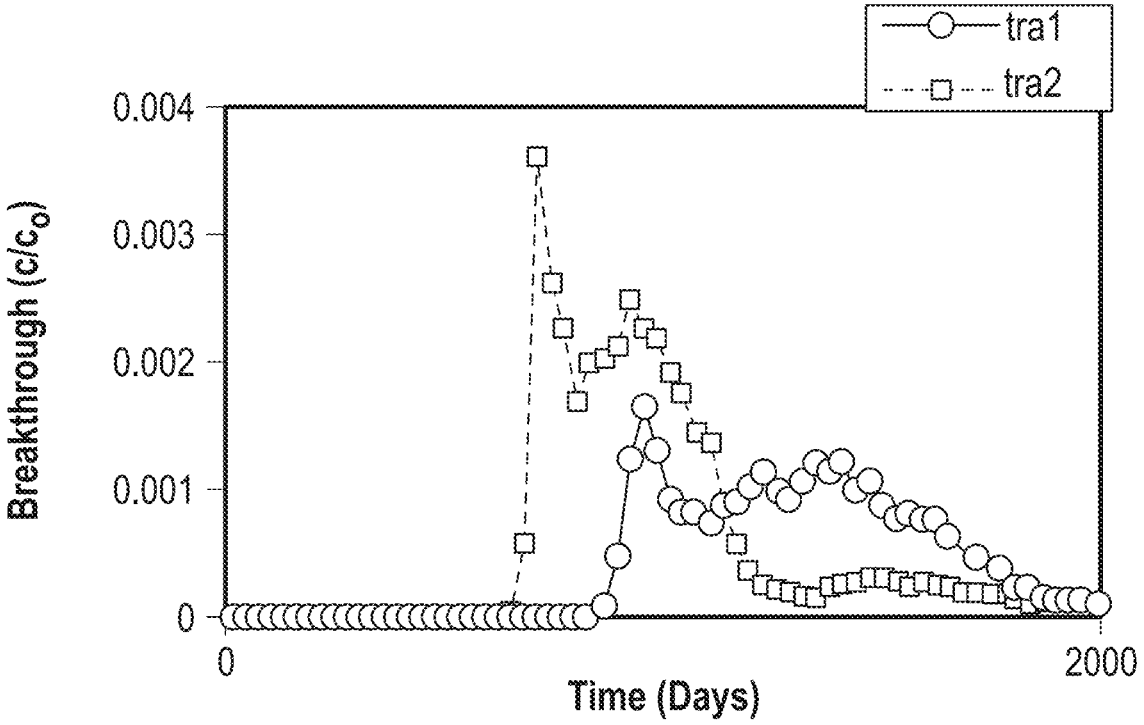
Figure 5H:
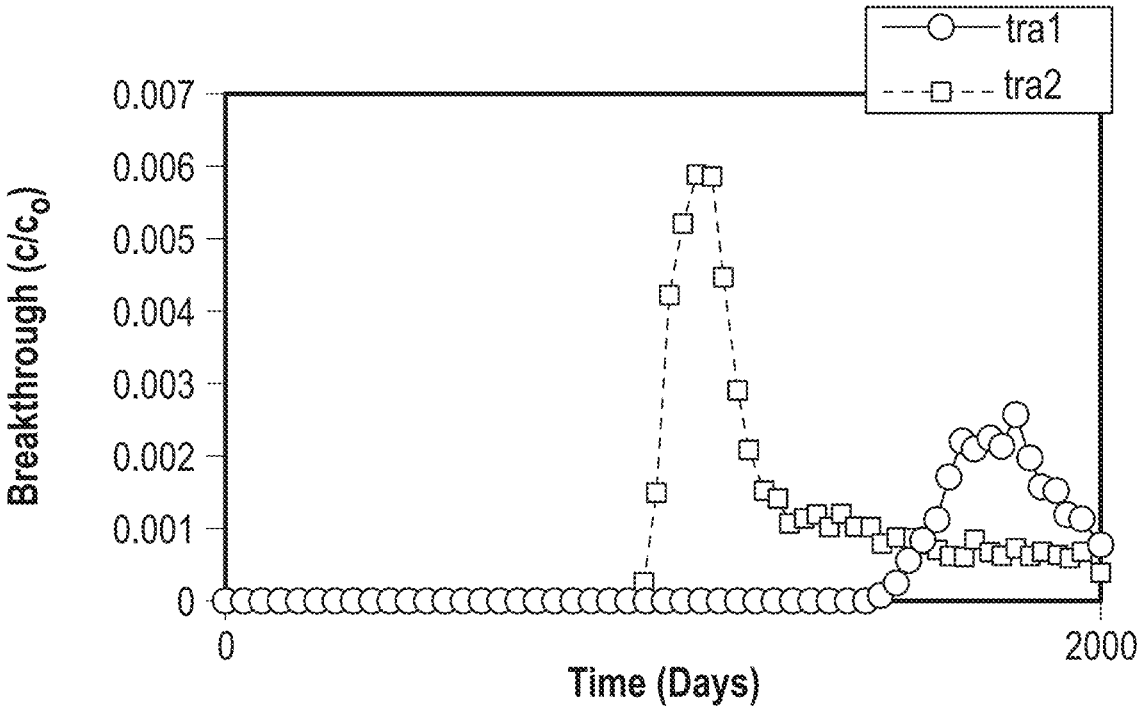

FIGS. 5A-H show the simulated reference data for oil production rates (opr), water production rates (wpr), Type 1 tracer breakthroughs (tra1), and Type 2 tracer breakthroughs (tra2) from each of the 4 producer wells. FIGS. 5A and 5E show simulated reference data for producer well p1. FIGS. 5B and 5F show simulated reference data for producer well p2. FIGS. 5C and 5G show simulated reference data for producer well p3. FIGS. 5D and 5H show simulated reference data for producer well p4. Random noises with 10% standard deviations were added to the reference data to approximate real field responses. As shown, all producer wells first produced oil and observed water cuts later (shown by FIGS. 5A-D). In addition, the Type 2 tracer had earlier breakthroughs at each producer well compared to the Type 1 tracer breakthroughs (shown by FIGS. 5E-H). It is important to note, that peaks for tra1 and tra2 in p1 were ~50 days apart, as shown in FIG. 5E, while the peaks for tra1 and tra2 were ~700 days apart in p4, as shown in FIG. 5H, which provided inter-well porosity information.

Figure 6A:
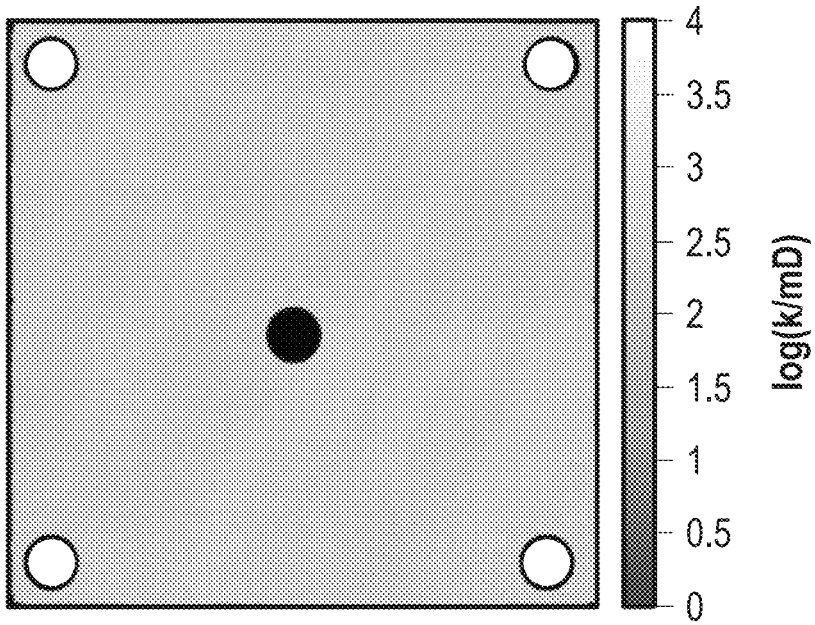
FIGS. 6A-H show graphs of predicted reservoir models in accordance with embodiments of the present disclosure.
Figure 6B:
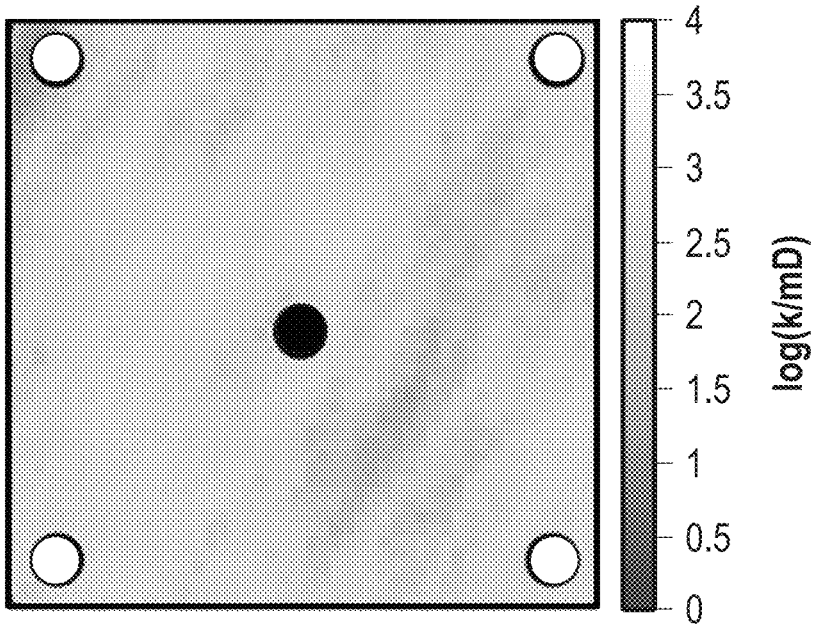
Figure 6C:
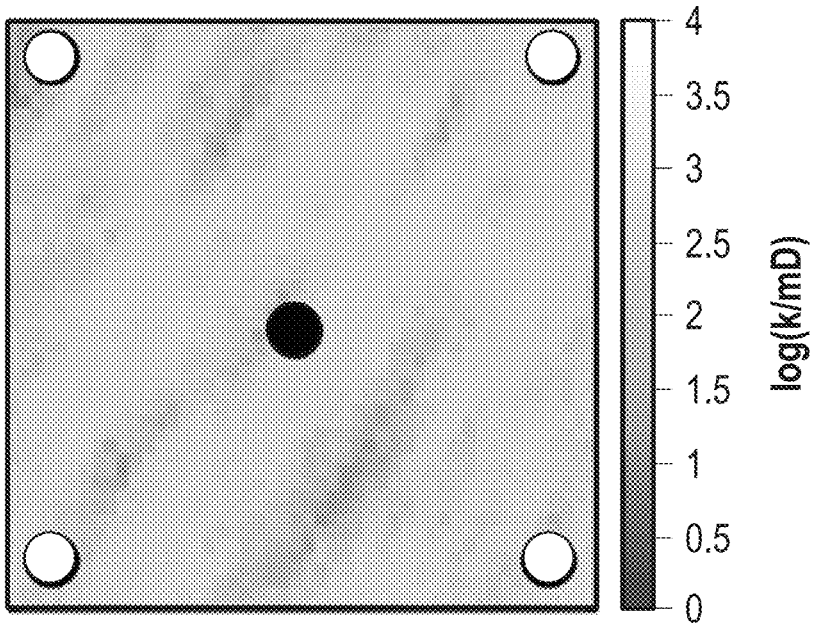
Figure 6D:
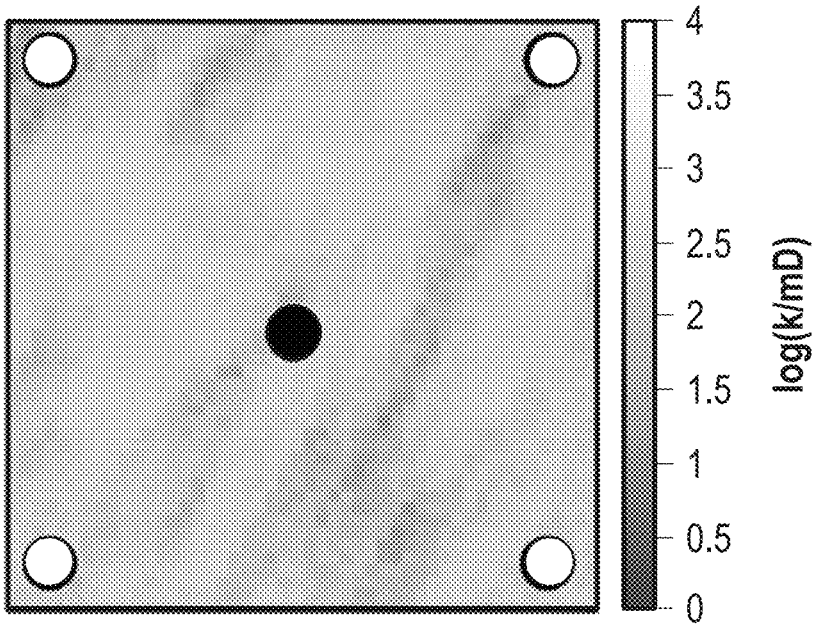
Figure 6E:
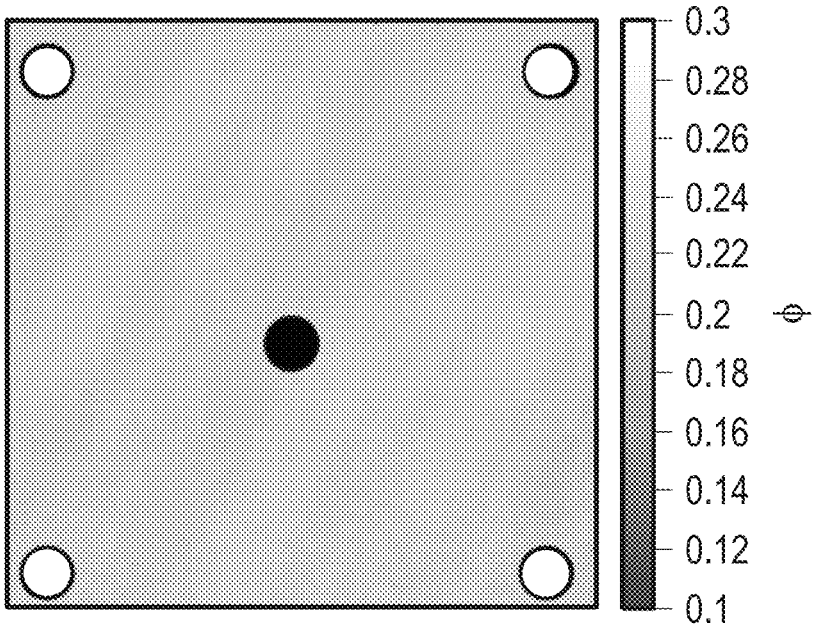
Figure 6F:
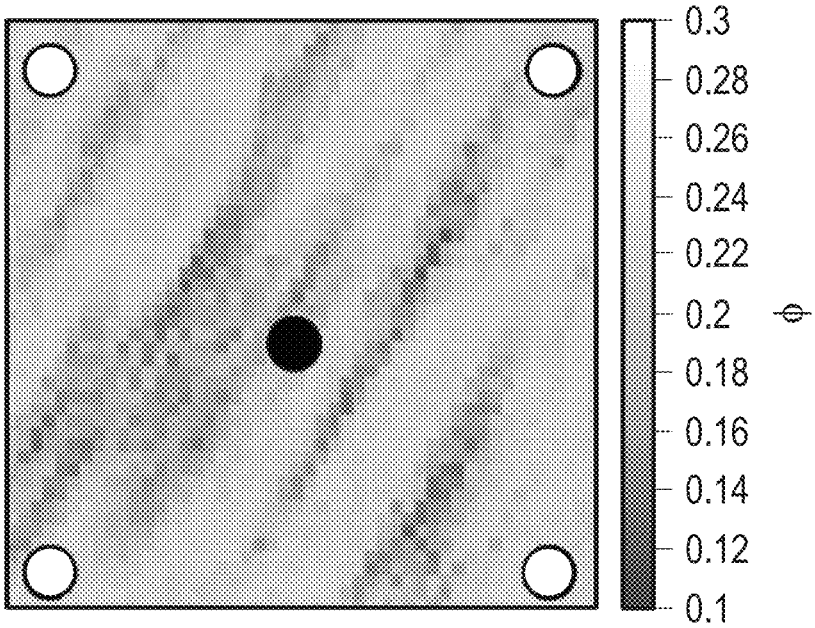
Figure 6G:
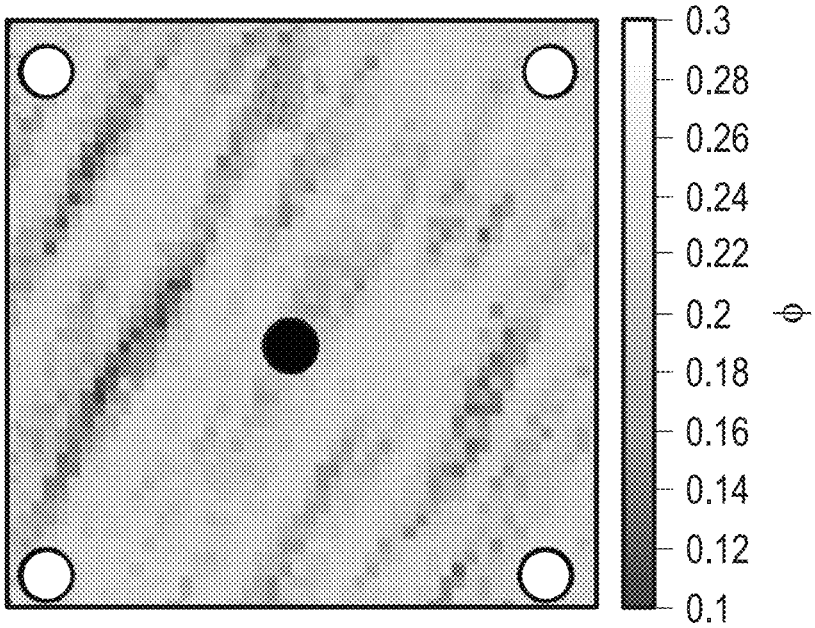
Figure 6H:
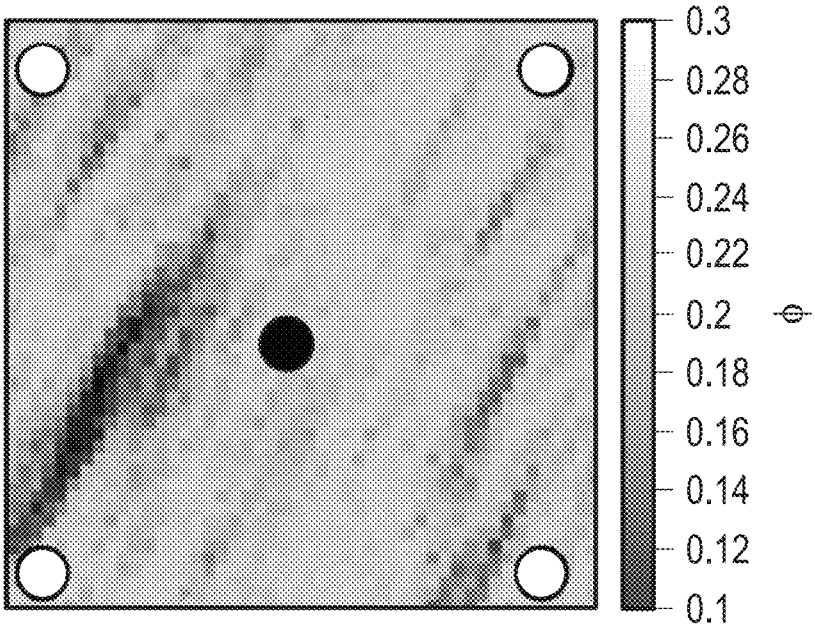

FIGS. 6A-H show the predicted permeability and porosity distributions using different variations of a history matching algorithm in accordance with the present disclosure, for example, the previously described ES-MDA-Tracer algorithm. Different variations of the modified ES-MDA-Tracer algorithm include different sets of history matching data that are input into the algorithm. FIGS. 6A and 6E show the predicted porosity and permeability distributions without including any history matching data. FIGS. 6B and 6F show the predicted porosity and permeability distributions with opr and wpr history matching data. History matching data includes the data obtained from the reservoir simulations described above, such as the opr, wpr, tra1 and tra2 breakthrough curves. FIGS. 6C and 6G show the predicted porosity and permeability distributions with opr, wpr, and tra1 history matching data. FIGS. 6D and 6H show the predicted porosity and permeability distributions with opr, wpr, tra1, and tra2 history matching data. Including opr, wpr, tra1, and tra2 data in the algorithm resulted in the most accurate inter-well porosity predictions, shown in FIG. 6H.

Figure 7A:
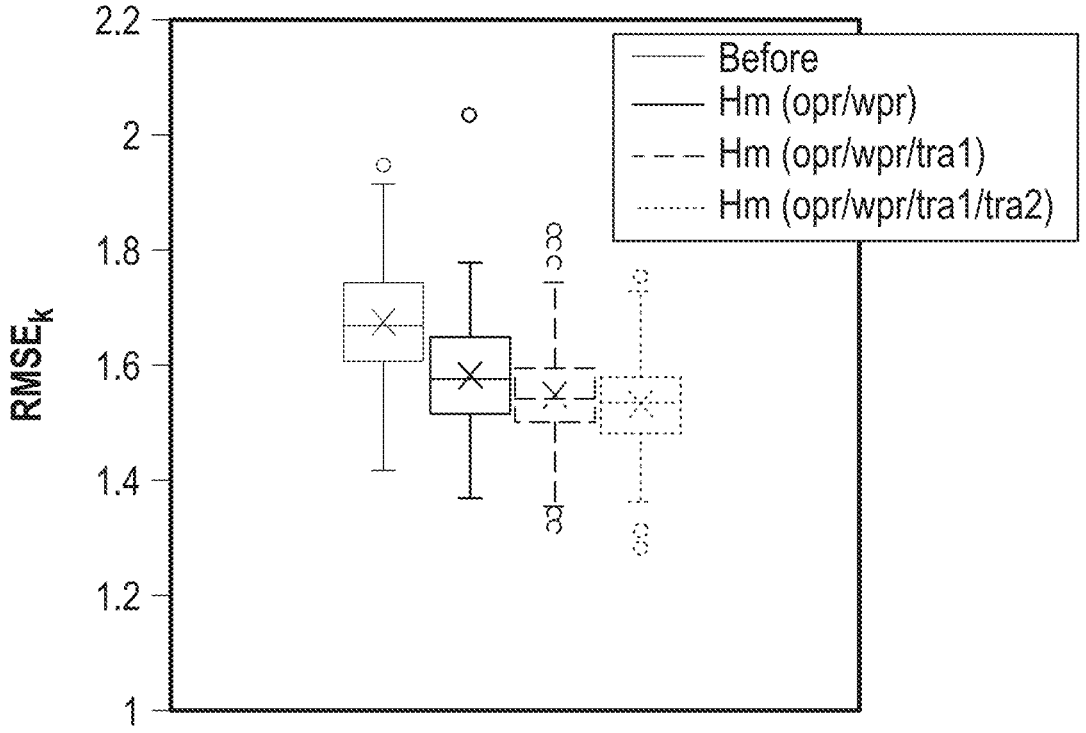
FIGS. 7A-B show graphs of root mean squared errors in predicted reservoir models in accordance with embodiments of the present disclosure.
Figure 7B:
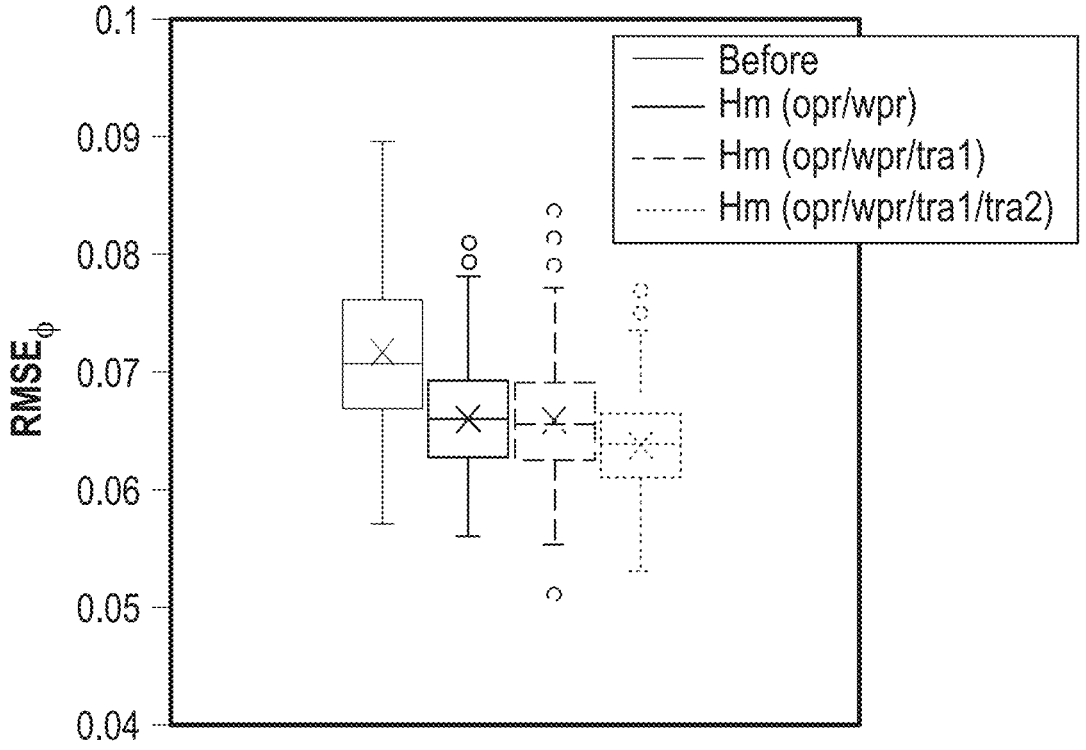

To quantify the mismatches between the history matching predictions (FIGS. 6A-H) with the reference (FIGS. 4A-B), the root-mean-square errors (RMSE) was calculated, as defined by the following equation:

$$RMSE = \sqrt{\frac{1}{N_m}\|m - m_{true}\|_2^2}$$

with model permeability distributions $m_k(r)=\log(k(r)/mD)$, model porosity distributions $m_\varphi(r)=\varphi(r)$, and $N_m$ is the total number of model parameters. As shown in FIGS. 7A and 7B, including opr, wpr, tra1 and tra2 in history matching resulted in the lowest data mismatches for both $RMSE_k$ and $RMSE_\varphi$, indicating the validity of the proposed workflow. Thus, better inter-well porosity mappings in history matching may be achieved using not only the production data, but also the Type 1 and Type 2 tracer breakthroughs.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for mapping inter-well porosity comprising:

injecting a Type 1 tracer into a hydrocarbon-bearing reservoir via an injector well, wherein the Type 1 tracer is a passive tracer;

injecting a Type 2 tracer into the hydrocarbon-bearing reservoir via the injector well, wherein the Type 2 tracer is a porosity-sensitive tracer;

detecting a breakthrough of the Type 1 tracer and a breakthrough of the Type 2 tracer in produced fluid at a producer well; and comparing the breakthrough of the Type 1 tracer with the breakthrough of the Type 2 tracer to provide a map of inter-well porosity.

2. The method of claim 1, wherein the Type 1 tracer is selected from the group consisting of dipicolinic acid (DPA), 4,7-bis(sulfonatophenyl)-1,10-phenanthroline-2,9-dicarboxylic acid (BSPPDA), 2-fluorobenzoic acid, 3-fluorobenzoic acid, 4-fluorobenzoic acid, 2,3-difluorobenzoic acid, 2,4-difluorobenzoic acid, 2,5-difluorobenzoic acid, 3,4-difluorobenzoic acid, sodium thiocyanate (NaSCN), sodium bromide (NaBr), and combinations thereof.

3. The method of claim 1, wherein the Type 1 tracer doesn't degrade in at least 100° C. for 3 to 6 months.

4. The method of claim 1, wherein the Type 2 tracer is a polymer having a polydispersity ranging from 1.0 to 1.5.

5. The method of claim 4, wherein the polymer has a molecular weight (Mw) ranging from 30,000 Da to 20,000,000 Da.

6. The method of claim 1, wherein the Type 2 tracer has a size that is larger than an inaccessible pore volume (IPV) in the hydrocarbon-bearing reservoir, wherein the IPV ranges from 10 to 50% of a total pore volume in the hydrocarbon-bearing reservoir.

7. The method of claim 1, wherein the Type 2 tracer is a polymer prepared via a controlled/living radical polymerization technique selected from the group consisting of reversible addition-fragmentation chain-transfer (RAFT), atom transfer radical polymerization (ATRP), activator regenerated by electron transfer atom transfer radical polymerization (ARGET ATRP), and combinations thereof.

8. The method of claim 1, wherein the Type 2 tracer is a brine soluble polymer.

9. The method of claim 1, wherein the Type 2 tracer is a polymer including monomers selected from the group selected from saccharides, sulfonated monomers, hydroxylated monomers, zwitterionic monomers, fluorinated monomers, and combinations thereof.

10. The method of claim 1, wherein the Type 2 tracer comprises a zwitterionic/fluorinated copolymer selected from the group consisting of poly(1-vinyl imidazole-co-4-trifluoromethylstyrene), poly(3-(1-vinyl-1H-imidazol-3-ium-3-yl)propane-1-sulfonate-co-4-trifluoromethylstyrene), and poly(3-(1-vinyl-1H-imidazol-3-ium-3-yl)propane-1-sulfonate), and combinations thereof.

11. The method of claim 1, wherein the Type 2 tracer doesn't degrade in at least 100° C. for 3 to 6 months.

12. The method of claim 1, wherein the breakthrough of the Type 1 tracer is slower than the breakthrough of the Type 2 tracer.

13. The method of claim 1, wherein the detecting a breakthrough of the Type 1 tracer and a breakthrough of the Type 2 tracer in produced fluid is performed by standard analytical chemistry techniques selected from the group consisting of solid phase extraction (SPE), gas chromatography-mass spectroscopy (GC-MS), high performance liquid chromatography (HPLC), and combinations thereof.

14. The method of claim 1, wherein the comparing the breakthrough of the Type 1 tracer and the breakthrough of the Type 2 tracer is performed using an Ensemble Smoother with Multiple Data Assimilation with Tracers (ES-MDA-Tracer) algorithm.

15. A method of reconstructing inter-well porosity of a hydrocarbon-bearing reservoir using Type 1 tracer breakthrough data and Type 2 tracer breakthrough data, the method comprising:

obtaining an initial reservoir model;

performing reservoir simulation using the initial reservoir model to predict hydrocarbon production rate, water production rate, Type 1 tracer breakthrough data, and Type 2 breakthrough data from a producer well;

obtaining a real field hydrocarbon production rate, real water production rate, real Type 1 tracer breakthrough data, and real Type 2 tracer breakthrough data from the producer well; and performing data assimilation by comparing real field production, real field Type 1 tracer breakthrough data, and real field Type 2 tracer breakthrough data with the predicted production, the predicted Type 1 tracer breakthrough data, and the predicted Type 2 tracer breakthrough data obtained from the reservoir simulation using the initial reservoir model.

16. The method of claim 15, wherein the Type 1 tracer is a passive tracer.

17. The method of claim 15, wherein the Type 2 tracer is a porosity-sensitive tracer.

18. The method of claim 15, wherein the Type 1 tracer breakthrough is slower than the Type 2 tracer breakthrough.

* * * * *